United States Patent [19]

Tendrup et al.

[11] Patent Number: 4,623,079

[45] Date of Patent: Nov. 18, 1986

[54] GARMENT HANGER WITH GRIP

[76] Inventors: Donald Tendrup, 32 Del Marie La., Nesconsett, N.Y. 11767; Joseph DeVito, 7 Ingrid Ct., Hauppauge, N.Y. 11788

[21] Appl. No.: 344,209

[22] Filed: Jan. 29, 1982

[51] Int. Cl.[4] ..... A47G 25/36; A47G 25/48

[52] U.S. Cl. ..... 223/85; 223/93; 223/96; D6/326

[58] Field of Search ..... 223/85, 91, 93, 96; D6/252, 253, 254, 255, 326; 24/255 BS, 137 R, 138

[56] References Cited

U.S. PATENT DOCUMENTS

| | | | |
|---|---|---|---|
| 119,938 | 10/1871 | Mellish | 24/138 |
| 143,024 | 9/1873 | Mellish | 24/138 |
| D. 264,912 | 6/1982 | Bliss et al. | D6/254 |
| 2,471,141 | 5/1949 | Castelli | 24/138 |
| 3,076,242 | 2/1963 | Priolo | 24/138 |
| 3,327,912 | 6/1967 | Blair | 223/85 |
| 3,464,605 | 9/1969 | Apel | 223/96 |
| 3,570,729 | 3/1971 | Zuckerman | 223/96 |
| 3,738,549 | 6/1923 | Driscoll | 223/85 |
| 4,148,421 | 4/1979 | Levitt | 223/91 X |

FOREIGN PATENT DOCUMENTS

| | | | |
|---|---|---|---|
| 401137 | 5/1968 | Australia | 223/96 |
| 1424774 | 12/1965 | France | 223/91 |
| 1514978 | 6/1978 | United Kingdom | 223/96 |
| 2069332 | 8/1981 | United Kingdom | 223/85 |

*Primary Examiner*—Robert R. Mackey
*Attorney, Agent, or Firm*—Bauer & Amer

[57] ABSTRACT

An improved garment-engaging grip of a plastic ship-on-hanger in which a cooperating finger and wall engage an interposed garment therebetween, and the finger is movable into a clearance provided behind it to allow for the bulk of the garment, to thereby relieve, by virtue of this adjustment in position of the finger, any stress in the plastic at the juncture of the finger connection to the hanger and, thus, the tendency to rupture at said juncture. The finger additionally has a gripping projection in the form of a bump, which significantly increases the gripping pressure on the garment.

1 Claim, 7 Drawing Figures

GARMENT HANGER WITH GRIP

The present invention relates generally to inexpensive plastic ship-on or garment display hangers, of the type exemplified by the hanger of U.S. Pat. No. 4,148,421, and more particularly to improvements in the garment-engaging grips of these type hangers.

As understood, the garment-gripping structure of a typical throw-away or ship-on hanger includes a finger which is pushed slightly away from a gripping wall or surface as the garment is inserted in a slot bounded by said finger and wall. The garment gripped or supported on the hanger is then shipped to a retailer who conveniently, i.e. without extensive handling, hangs the product on a rod or other support of a display. It frequently inadvertently happens, however, that the finger portion of the grip which, as noted, is pushed slightly to one side, ruptures or breaks at its connection to the hanger because of stress which develops in the plastic construction material of the hanger.

Broadly, it is an object of the present invention to obviate breakage in the finger grip of a plastic garment hanger and, in other respects as well, to overcome the foregoing and other shortcomings of the prior art. Specifically, it is an object to minimize the development of any stress in the plastic material of the hanger due to the position assumed by the garment-gripping components, and yet achieve a firm, if not firmer, grip on the attached garment, as provided by prior art ship-on hangers. To even enhance further the gripping force exerted on the garment, the finger of the hanger which grips the garment is provided with a projection which is pushed firmly into, and thus frictionally engages the garment, all as is explained in greater detail subsequently.

An improved garment grip for a plastic ship-on hanger demonstrating objects and advantages of the present invention includes the provision therein of a garment-receiving slot bounded along one side by a wall surface of said hanger and along an opposite side by a resilient finger member located in an adjacent clearance position from said wall surface. The resilient finger member is so molded as to have a gripping projection thereon and also to be movable in a direction transverse to and away from said wall surface, this degree of movement being the result of said finger being disposed in a clearance position from any portion of said hanger on both its opposite sides. In practice, therefore, the finger is movable away from the wall surface into the provided clearance space to thus provide an enlarged size to the garment-receiving slot incident to the insertion of a garment therein while remaining in gripping engagement with said inserted garment. Additionally, and most importantly, the movement of the finger obviates any stress in the plastic construction material of the hanger at the connecting juncture of the grip with the hanger, thereby significantly prolonging the period of usefulness thereof.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

As understood, there are numerous embodiments of inexpensive plastic injection molded hangers to which garments are attached at the factory or other manufacturing site and shipped to the retailer, who then can conveniently transfer same to his display racks. The hangers referred to are typically known as "ship-on" hangers and afford the obvious convenience to the retailer of having the garment being sold in a display position on a hanger which, in turn, can readily be placed on a support rod of a display rack with little or no handling. Moreover, the hanger is so inexpensive that it is feasible to discard it, if the customer so chooses, when the purchase is completed, the hanger having achieved its primary function of advantageously displaying the garment so as to contribute to the sale thereof.

Figure 1:
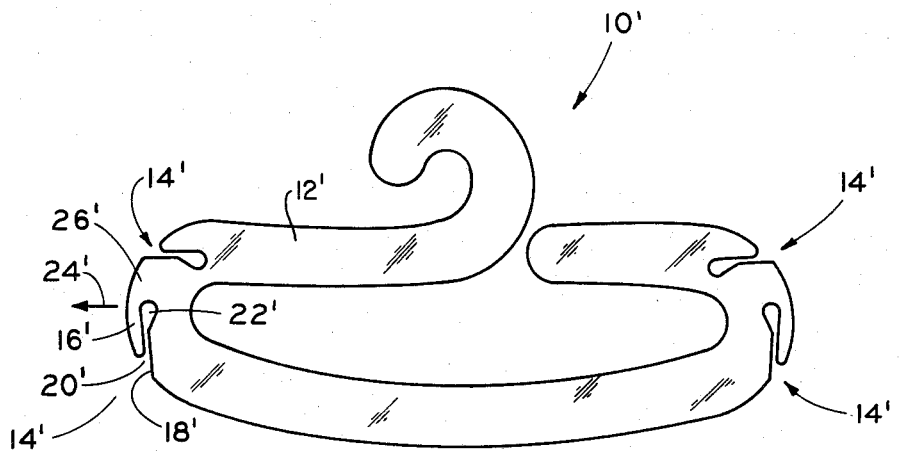
Fig. 1 PRIOR ART
FIGS. 1 and 2 are front elevational views of prior art plastic hangers used for the same commercial purposes as the within inventive hanger and are helpful in illustrating the improvements constituting the within inventive contribution.

The economic need for a ship-on plastic hanger, as just generally described, has thus resulted in numerous variations which each differ from each other as to specific structural features which, as exemplified by the prior art hanger of FIG. 1, have certain basic or characterizing structural features. More particularly, in the typical prior art hanger, such as the one illustrated in FIG. 1 and intended to be the hanger of prior U.S. Pat. No. 4,148,421 and generally designated 10' in said figure, said hanger includes, as is well understood, a flat plastic body 12' which has integrally molded garment-engaging grips 14' at strategic locations thereabout, all as is illustrated in FIG. 1. Further as is generally understood, each garment grip 14' includes a finger 16' in an adjacent location opposite a wall surface 18' that is part of the plastic hanger body. As a result, there is formed between the finger 16' and wall 18' a slot 20' to receive therebetween a waistband or other part of a garment that is intended to be supported on the hanger 10'.

In referring to the prior art hanger 10' of FIG. 1, it is significant to note that in inserting the garment into the clearance 22' of the finger grip 14', finger 16' will be urged in the direction 24' in order to make allowance for the bulk of the garment waistband or the like that is inserted into the slot or compartment portion 22' of said slot. Finger 16' remains in this slightly angular position and, in practice, it has been found that, as a result thereof, stress concentrations occur in the plastic construction material of the hanger 10', which ultimately results in rupture of the finger 16'. This rupture, more particularly, occurs at the connecting juncture of the finger 16' with the hanger body 12', as at 26'.

Figure 2:
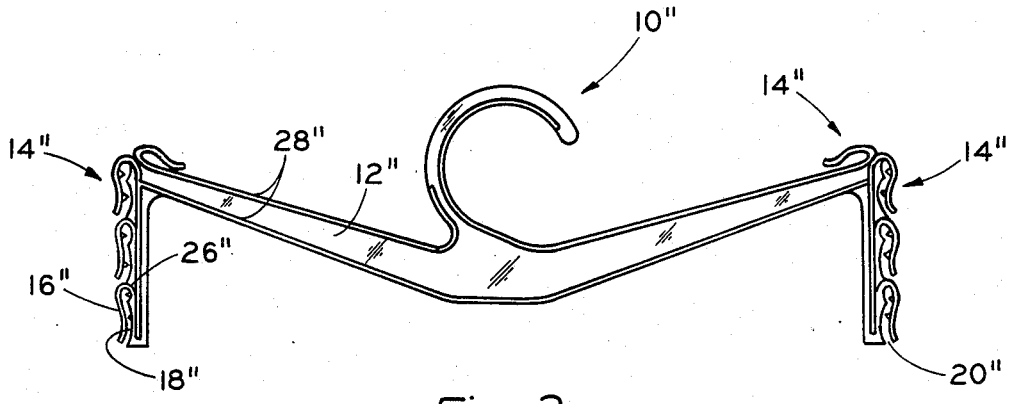
Fig. 2 PRIOR ART

There have, of course, been numerous attempts to obviate the rupturing of the garment-gripping fingers of the hanger at their juncture with the plastic garment body, as above explained. For example, in another model of a prior art hanger 10", as illustrated in FIG. 2, the finger 16" is comprised essentially as a reinforced edge or rib, similar, for example, to the peripheral ribs 28" which traditionally and effectively serve to increase the structural strength of the hanger body 12". This type of solution, while somewhat effective, does not totally obviate the problem. In practice, even on the prior art hanger 10" of FIG. 2, it has been found that finger 16" of the integrally molded grip 14" still ruptures at the location 26" when a garment waistband or the like is inserted into the slot 20" incident to being gripped on opposite sides by the finger 16" and the garment-gripping wall surface 18".

Figure 3:
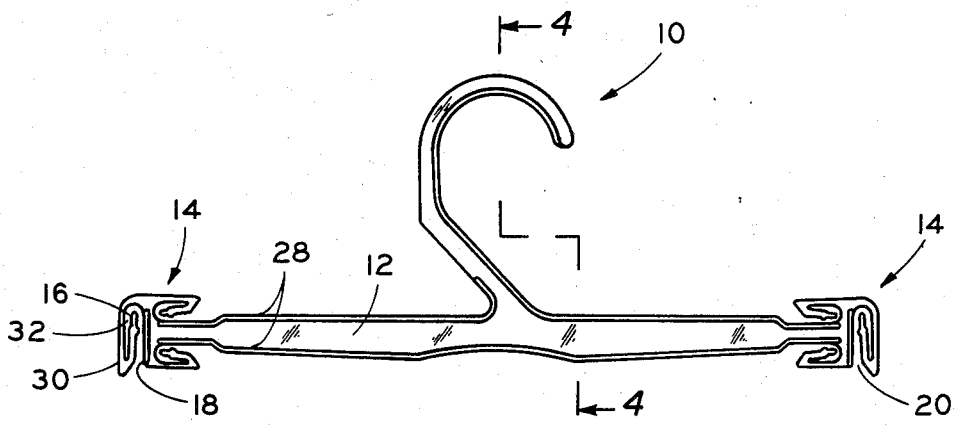
FIG. 3 is a front elevational view of an improved garment hanger according to the present invention in which, more particularly, the improvements reside in a first embodiment of garment grips which are significantly less susceptable to breakage than the grips of the hangers of FIGS. 1 and 2.
Figure 4:
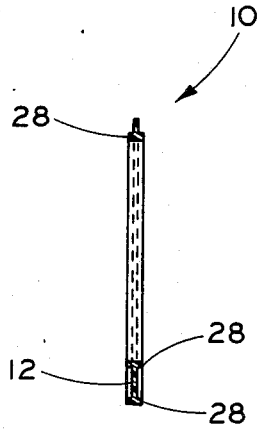
FIG. 4 is a side elevational view, in section taken along line 4—4 of FIG. 3.
Figure 5:
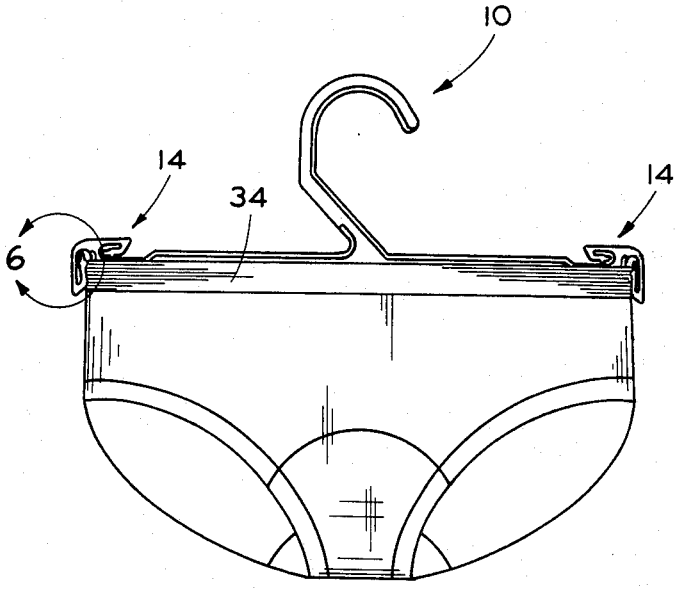
FIG. 5 is a front elevational view demonstrating the functioning of the within inventive garment grip.

An effective solution which obviates rupturing in a garment-gripping finger is illustrated in the ship-on garment hanger illustrated more particularly in FIGS. 3–5 and the detailed views FIGS. 6 and 6*a* projected therefrom, which now will be explained in sufficient detail for a complete comprehension of the inventive concept. More particularly, the hanger 10 illustrated therein embodies in many respects the conventional structural features of the prior art hangers of FIGS. 1 and 2 already described. Thus, for brevity's sake, the conventional structural features embodied by the improved garment hanger of FIGS. 3–5 will not be again described, it being suffice that these structural features are designated by the same, but unprimed, reference numerals used in connection with the descriptions of the hangers of FIGS. 1 and 2. What distinguishes the inventive hanger 10 are structural features embodied in the garment-engaging grips 14, which will now be described in detail and which consist of those structural features starting with reference numeral 30. More particularly, and as clearly illustrated in FIG. 3, each finger grip 14 includes the same finger 16 in an adjacent clearance position from a garment-gripping wall 18 so as to bound therebetween a slot 20 for the insertion of a garment waistband or the like therein. However, finger 16 is attached to the garment body 12 by a connecting section or leg. The importance of this is that finger 16 can then be integrally molded with an additional clearance space 32 behind said finger, as well as with a clearance space 20 between it and the garment-engaging wall 18. Thus, each finger grip 14 embodied in the inventive hanger 10, being three in number at each end of the hanger as clearly illustrated in FIG. 3, has provision for a clearance space 32 on one side of the finger 16 as well as the usual clearance space 20 on the opposite side thereof. The provision of the clearance space 32 in the location just noted contributes significantly to the manner in which each garment grip 14 functions, all as will now be explained in detail and as best can be understood by progressive examination of FIGS. 6 and 6*a*.

Figure 6:
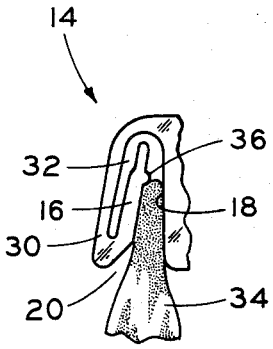
FIGS. 6 and 6*a* are enlarged scale illustrations of the grip encircled by the reference line 6 of FIG. 5 and demonstrate, by progressive examination, the functioning of the grip.
Figure 6A:
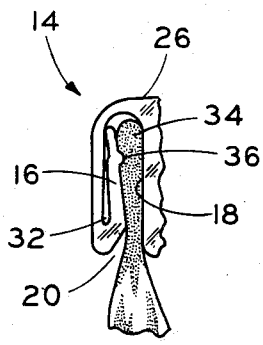

More particularly, as illustrated in FIGS. 6 and 6*a*, a garment waistband 34 is typically inserted into the slot 20 of finger grip 14 and this, of course, results in a slight angular movement in both the finger 16 and connecting leg away from the wall surface 18, such movement, of course, being necessary to allow for the bulk of the garment waistband being inserted into the slot 20. Instead of remaining in the angular orientation illustrated in FIG. 6, however, the garment grip 14 assumes the condition illustrated more particularly in FIG. 6*a*. That condition, more particularly, is one in which the finger 16 remains in gripping contact with the garment waistband 34 but said finger 16 makes sufficient allowance for the bulk of the waistband 34 by easing slightly into the clearance 32 or, in other words, in a direction transverse to and away from the garment-gripping wall surface 18. As a result, in the inventive hanger 10 of FIGS. 3–5, the garment is under a firm grip in its interposed position between the finger 16 and the wall 18, but the referred to finger movement into the clearance space 32 has been found, in practice, to effectively relieve any stress in the plastic construction material of the hanger 10 at the location 26, at which the prior art hangers were significantly susceptible to breakage or rupture.

As may best be observed in the enlarged scale illustrations of FIGS. 6 and 6*a*, the side of the finger 16 in facing relation to the wall 18, and thus in facing relation also to the garment 34 interposed therebetween, is molded with a gripping projection in the specific form of a bump 36. The bump or projection 36 is thus advantageously maitained in a pressed condition into the garment 34 incident to movement of finger 16 away from the wall 18, and this significantly enhances the frictional gripping force exerted on the inserted garment.

For completeness' sake, it is to be noted that use can effectively be made not only of a vertically oriented grip 14 but also a horizontally oriented embodiment thereof, and that whether vertically or horizontally oriented the result is the same in that movement of the finger of the grip into a clearance behind the finger effectively relieves any rupture-causing stress in the construction material at the connecting juncture between the finger and the body of the hanger.

From the foregoing it should be readily appreciated that there has been described herein a plastic ship-on hanger of styrene or similar construction material in which there is effective provision for relieving the hanger of stress which ultimately results in rupture as a result of accomodating the bulk of the portion of the garment inserted into the gripping mechanism thereof. Although a preferred embodiment of a garment-gripping means 14 has been described herein, it will be understood that a latitude of modification, change and substitution is intended in the description thereof, and that in some instances some features of the invention will be employed without a corresponding use of other features. Accordingly, it is appropriate that the appended claims be construed broadly and in a manner consistent with the spirit and scope of the invention herein.

What we claim is:

1. In a hanger of plastic construction material and of the type having a centrally located hook for being suspended from a support, a body connected to the base of said hook oriented horizontally when used, and at each of the opposite ends of said body, plural garment-engaging grips molded integral therewith, at least one said garment-engaging grip comprising a vertically oriented wall surface of said hanger extending from a location adjacent the upper edge of said body to a location at the lower edge thereof, a U-shaped configuration molded therein so as to present a first downwardly extending resilient finger and a reverse direction upwardly extending second resilient finger spaced inwardly of said first finger, said second resilient finger being located in an adjacent clearance position from said wall surface for the entire vertical length thereof such that there is a first clearance space between one side of said second finger and said wall surface defining a garment-receiving slot therebetween and a second clearance space along said opposite side of said second finger for allowing transverse movement in said second finger in a direction away from said wall surface, said second resilient finger being movable in a direction transverse to and away from said wall surface by displacement into said second clearance space, and a bump molded on said finger in facing relation to said wall surface, and at least another said garment-engaging grip comprising a horizontally oriented wall surface of said hanger extending from a location adjacent an end edge of said body to a location inwardly thereof, a U-shaped configuration molded therein so as to present a first horizontally extending resilient finger and a reverse direction horizontal extending second resilient finger spaced inwardly of said first horizontally extending finger, said second horizontally extending finger being located in an adjacent clearance position from said horizontally oriented wall surface such that there is a first clearance space between one side of said second finger and said wall surface defining a garment-receiving slot therebetween and a second clearance space along said opposite side of said second finger for allowing transverse movement in said second finger in a direction away from said wall surface, said second resilient finger being movable in a direction transverse to and away from said wall surface by displacement into said second clearance space, and a bump molded on said finger in facing relation to said wall surface, whereby said second finger of each said garment-engaging grip is movable away from said wall surface into said second space to provide an enlarged size to said garment-receiving slot for said entire length thereof incident to the insertion of a garment therein to an extent providing sufficient bulk for said second finger to remain in gripping engagement with said inserted garment and wherein said movement of said second finger caused by said bulk obviates stress in said construction material at the connecting juncture of each said grip with said hanger.

* * * * *

US004623079B1

REEXAMINATION CERTIFICATE (2746th)

United States Patent [19]

Tendrup et al.

[11] B1 4,623,079

[45] Certificate Issued * Dec. 5, 1995

[54] GARMENT HANGER WITH GRIP

[75] Inventors: Donald Tendrup, Nesconsett; Joseph DeVito, Hauppauge, both of N.Y.

[73] Assignee: Plasti-Form Enterprises, Inc., Deer Park, N.Y.

Reexamination Request:
No. 90/002,827, Sep. 8, 1992

Reexamination Certificate for:

| | |
|---|---|
| Patent No.: | **4,623,079** |
| Issued: | **Nov. 18, 1986** |
| Appl. No.: | **344,209** |
| Filed: | **Jan. 29, 1982** |

[ * ] Notice: The portion of the term of this patent subsequent to Dec. 16, 2003, has been disclaimed.

[51] Int. Cl.[6] ..... A47G 25/36; A47G 25/48

[52] U.S. Cl. ..... 223/85; 223/93; 223/96; D6/326

[58] Field of Search ..... 223/85, 95, 96, 223/91

[56] References Cited

U.S. PATENT DOCUMENTS

| | | |
|---|---|---|
| 33,665 | 12/1900 | Kramer . |
| 119,938 | 10/1884 | Mellish . |
| 122,692 | 9/1840 | Owen . |
| 143,024 | 7/1873 | Mellish . |
| 159,252 | 7/1850 | Cook . |
| 167,986 | 10/1852 | Jonaitis . |
| 194,726 | 2/1863 | Allen . |
| 196,469 | 10/1863 | Kennedy . |
| 204,134 | 3/1866 | Duncan . |
| 214,968 | 8/1869 | Field et al. . |
| 219,488 | 12/1889 | Schayer . |
| 236,572 | 9/1875 | Ostroll . |
| 244,197 | 5/1877 | Ostroll . |
| 246,817 | 1/1878 | Mainetti . |
| 258,336 | 2/1881 | Vacoe . |
| 264,912 | 6/1882 | Bliss et al. . |
| 491,062 | 1/1893 | Granger . |
| 697,103 | 4/1902 | Pickhardt . |
| 723,587 | 12/1901 | Cowles . |
| 769,694 | 4/1903 | Geisert . |
| 817,130 | 1/1899 | Skinner . |
| 1,315,823 | 2/1919 | Dugan . |
| 1,447,083 | 9/1921 | Jonas . |
| 1,605,918 | 11/1925 | Buchanan . |
| 2,095,900 | 10/1937 | Albert . |
| 2,107,026 | 2/1938 | Coney . |
| 2,145,120 | 1/1939 | Loveless . |
| 2,171,680 | 9/1939 | Baugh . |
| 2,318,084 | 5/1943 | LaPorte . |
| 2,393,632 | 1/1946 | Hartz . |
| 2,401,413 | 6/1946 | Colwell . |
| 2,419,723 | 4/1947 | Mack . |
| 2,421,307 | 5/1947 | Albrecht . |
| 2,471,141 | 5/1949 | Castelli . |
| 2,492,287 | 12/1949 | Hogan . |
| 2,620,103 | 12/1952 | Antolini . |
| 2,723,787 | 11/1955 | Bransdorf . |
| 2,908,431 | 10/1959 | Campbell . |
| 3,028,974 | 4/1962 | Loeb . |
| 3,041,696 | 7/1962 | Ferri . |
| 3,076,242 | 2/1965 | Priolo . |
| 3,209,966 | 10/1965 | Wach . |
| 3,225,977 | 12/1965 | Gandy . |
| 3,327,912 | 6/1967 | Blair . |
| 3,405,429 | 10/1968 | Vasquez . |
| 3,463,369 | 8/1969 | Moskowitz . |
| 3,464,605 | 9/1969 | Apel . |
| 3,524,226 | 8/1970 | Brown . |
| 3,570,729 | 3/1961 | Zuckerman . |
| 3,738,549 | 6/1973 | Driscoll . |
| 4,132,316 | 1/1979 | Schmidt . |
| 4,148,421 | 4/1979 | Levitt . |

FOREIGN PATENT DOCUMENTS

| | | |
|---|---|---|
| 401137 | 5/1968 | Australia . |
| 974290 | 2/1911 | France . |
| 1424774 | 3/1966 | France . |
| 1775341 | 6/1958 | Germany . |
| 7613691 | 10/1976 | Germany . |
| 7636729 | 3/1977 | Germany . |
| 910375 | 11/1952 | United Kingdom . |
| 1155472 | 6/1969 | United Kingdom . |
| 1514978 | 6/1978 | United Kingdom . |
| 2069332 | 8/1981 | United Kingdom . |
| 2058192 | 4/1981 | United Kingdom . |

*Primary Examiner*—C. D. Crowder

[57] ABSTRACT

An improved garment-engaging grip of a plastic ship-on-hanger in which a cooperating finger and wall engage an interposed garment therebetween, and the finger is movable into a clearance provided behind it to allow for the bulk of the garment, to thereby relieve, by virtue of this adjustment in position of the finger, any stress in the plastic at the juncture of the finger connection to the hanger and, thus, the tendency to rupture at said juncture. The finger additionally has a gripping projection in the form of a bump, which significantly increases the gripping pressure on the garment.

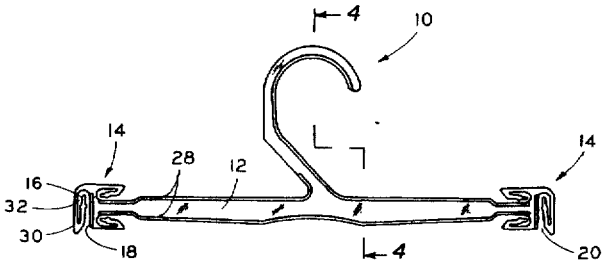

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 1 is confirmed.

* * * * *